United States Patent [19]

Boyer

[11] Patent Number: 5,014,676

[45] Date of Patent: May 14, 1991

[54] IGNITION SYSTEM WITH REPETITIVE SPARKS

[75] Inventor: Wesley D. Boyer, Dearborn, Mich.

[73] Assignee: Ford Motor Company, Dearborn, Mich.

[21] Appl. No.: 325,817

[22] Filed: Mar. 20, 1989

[51] Int. Cl.[5] ..... F02P 15/00; F02P 3/045

[52] U.S. Cl. ..... 123/637; 123/643

[58] Field of Search ..... 123/625, 637, 640, 643, 123/609

[56] References Cited

U.S. PATENT DOCUMENTS

| | | | |
|---|---|---|---|
| 3,945,362 | 3/1976 | Neuman et al. | 123/637 X |
| 4,091,787 | 5/1978 | Frank | 123/637 X |
| 4,112,890 | 9/1978 | Manger et al. | 123/637 X |
| 4,183,340 | 1/1980 | Gilbert | 123/620 X |
| 4,208,992 | 6/1980 | Polo | 123/643 X |
| 4,653,459 | 3/1987 | Herden | 123/637 |

FOREIGN PATENT DOCUMENTS

| | | | |
|---|---|---|---|
| 1501621 | 2/1978 | United Kingdom | 123/637 |

*Primary Examiner*—Tony M. Argenbright

*Attorney, Agent, or Firm*—Peter Abolins; Clifford L. Sadler

[57] ABSTRACT

A repetitive spark distributorless ignition system stops ignition current before the complete discharge of magnetic energy in the ignition coil supplying the spark plug. The ignition coil is then recharged so an additional spark can be applied to the spark plug.

9 Claims, 3 Drawing Sheets

IGNITION SYSTEM WITH REPETITIVE SPARKS

BACKGROUND OF THE INVENTION

1. Field of the Invention

The present invention relates to a method and apparatus to ignite a combustible gaseous mixture, particularly a mixture of gasoline vapor and air in the combustion chamber of an internal combustion engine utilizing a spark plug.

2. Prior Art

Ignition of a fuel-air mixture in the combustion chamber of an internal combustion engine (ICE) is done by a spark plug in which a high-voltage spark, for example generated by discharge of a capacitor, is caused to discharge across a firing or spark gap of the spark plug. The capacitor, or another energy storage device such as an ignition coil itself, is charged with energy and, at a predetermined time instant which may be controlled by a computer, the capacitor or other energy storage device discharges causing the spark to flash over at the spark gap. The spark gap ignites the combustible mixture within the combustion chamber of the ICE.

Timing of the spark in relation to the combustible charge, and the position of a piston in the ICE, usually taken with reference to the top dead-center (TDC) position of the piston, is important. The spark flash over is usually caused to occur at a predetermined time instant in advance of the TDC position of the piston so that the mixture will burn, and give off energy just at and after the piston has reached TDC position, to obtain maximum efficiency from the burning mixture. For most efficient operation, it is important that the mixture should burn as rapidly as possible within the combustion chamber, and that a frontal zone of combustion, or flaming, of the combustible mixture propagates as rapidly as possible.

The electrical discharge which occurs at the spark gap of the spark plug under control of the associated ignition system is, unfortunately, not a clearly analyzable occurrence or event as, for example, an electrical square-wave pulse or the like which controls the discharge. Rudolf Maly of the Institut für Physikalische Elektronik, Universität Stuttgart, has suggested in numerous papers that as the spark forms, three phases can be distinguished:

(1) the breakdown phase;

(2) the arcing phase; and (3) the glow phase.

The energy transferred in the various phases differs greatly. The formation of the respective phases depends to some extent on the geometry of the ignition electrodes, as well as on the associated circuitry connected thereto. If the ignition system provides a high-voltage pulse to the ignition electrodes, then, first, after the breakdown voltage has been exceeded, an electrically conductive plasma path will result. The currents which flow through the path between the electrodes may be very high. This occurs during phase (1), that is, the breakdown phase as the voltage falls from very high voltages (kilovolts) to voltages less than 10% of the peak.

The next phase is the arcing phase, the formation and course of which depends to some extent on the circuitry with which the spark plug is associated. The arcing phase causes current to flow in the previously generated plasma path. The voltage between the electrodes may be comparatively low or the current which flows at the beginning of the second, or arcing phase may be high. When the current during the arcing phase drops below a transition threshold, the arc will degenerate into a third, or glow phase which usually follows. The current during the third or glow phase continues to supply thermal energy to the media in the gap although much is lost to the electrodes during the relatively long period of time. The voltage is above the value of the voltage during the arcing phase.

The spark plug is stressed differentially during the respective phases. In the breakdown phase, the heat loading on the spark plug is low. In the arcing phase, the heat loading is high, and heat which is applied to the ignition electrodes of the spark plug leads to the well known erosion and deterioration of the spark plug. Relatively little erosion takes place during the glow discharge because of the low current densities and currents ($<100$ ma) that can be sustained.

The loading conditions applied to an Otto-type ICE result in different conditions of combustible mixtures in the combustion chamber. Upon full load operation, the mixture is rich and the degree of fill of the combustion chamber is high. Igniting such a mixture does not pose any problems. An accelerated transfer of energy is not even necessarily desired. If the ICE, however, operates at low loading, or under idling condition or, even under engine braking conditions, the temperature within the combustion chamber drops rapidly and the pressure also drops. The mixture is lean, and the degree of fill of the combustion chamber of the ICE is low. Non-homogeneties of the mixture occur, and consequently, ignition of the already lean, and possibly non-homogenous and insufficiently filled, mixture may cause difficulties.

Ignition systems are known which provide a succession of spark breakdowns in order to ensure ignition of the combustible mixture in an ICE. For example, it is known to sense the composition of the combustible fuel-air mixture, and to control the number of spark flashovers, or breakdowns at the sparking electrodes of the spark plug as a function of the ratio of fuel to air in the combustible fuel-air mixture.

U.S. Pat. No. 4,653,459 to Herden teaches engine control using the relationship of the number of spark breakdowns to the fuel-air mixture composition being supplied of the engine. However, specially constructed spark plugs are required to enhance the breakdown phase. Furthermore, the higher energy impulses of these breakdown sparks may lead to undesirable RFI (radio frequency interference) emissions.

To avoid having to reconfigure the ignition components, it would be desirable to use conventional inductive discharge hardware, preferably in a distributorless configuration, with repetitive firing, and communicating the ON/OFF control for this mode from a main engine control computer. Furthermore, by truncating the length of each glow discharge to recover energy which otherwise would be lost to the spark plug electrodes and providing a number of fresh ignition sources in a turbulent mixture by repetitively firing the same spark plug gap, there exists a higher probability of igniting a lean mixture. These are some of the problems this invention overcomes.

SUMMARY OF THE INVENTION

In accordance with an embodiment of this invention, repetitive sparks are produced using inductive discharge, without the need for special spark plug configurations or capacitive discharge energy storage. The ON/OFF control of the repetitive spark mode is communicated to an ignition module from a main engine control computer. For example, specific modulation of the pulse can be used to communicate the desired spark advance target value.

An advantage of a repetitively firing ignition system in accordance with an embodiment of this invention is the relative efficiency in drawing energy from the main source such as the automotive battery. Due to other system enhancements, the initial "DWELL" period is optimally delayed until just before the spark is required, then the ignition coil is energized and draws primary current through its inductance.

When the first spark occurs, the inductively stored energy is delivered directly through the secondary circuit to the spark plug. Since it takes considerable time to discharge this energy into the spark gap and the early time portion is the most effective in promoting combustion, this repetitive spark system turns the primary circuit back on before all of the energy has been dissipated in the spark. This allows a faster restrike frequency and recovers energy stored during the previous DWELL period that was not expended during the first spark.

Similar energy recovery is accomplished following the subsequent sparks until the final spark in the sequence is allowed to discharge completely. Thus, the crank angle over which the sparking occurs can be stretched from only about five degrees to about 30 degrees at an idling engine speed and each of the individual coil firings is capable of raising the secondary circuit to the breakdown potential of the spark plug. Since the repetition frequency is dependent upon the combined ON (dwell) and OFF (forced spark duration) times, and which interact with the battery supply voltage, secondary spark load characteristics, energy recovered, etc. the specific repetitive spark strategy is calibrated with respect to the appropriate engine system.

The ignition control strategy provides a burst of inductive discharge sparks in quick succession to each firing cylinder. Each spark has a short preprogrammed duration followed by a short dwell time designed to replace energy already expended in the spark. The final spark advantageously has a normal duration and begins no later than top dead center.

DETAILED DESCRIPTION OF THE INVENTION

Figure 1:
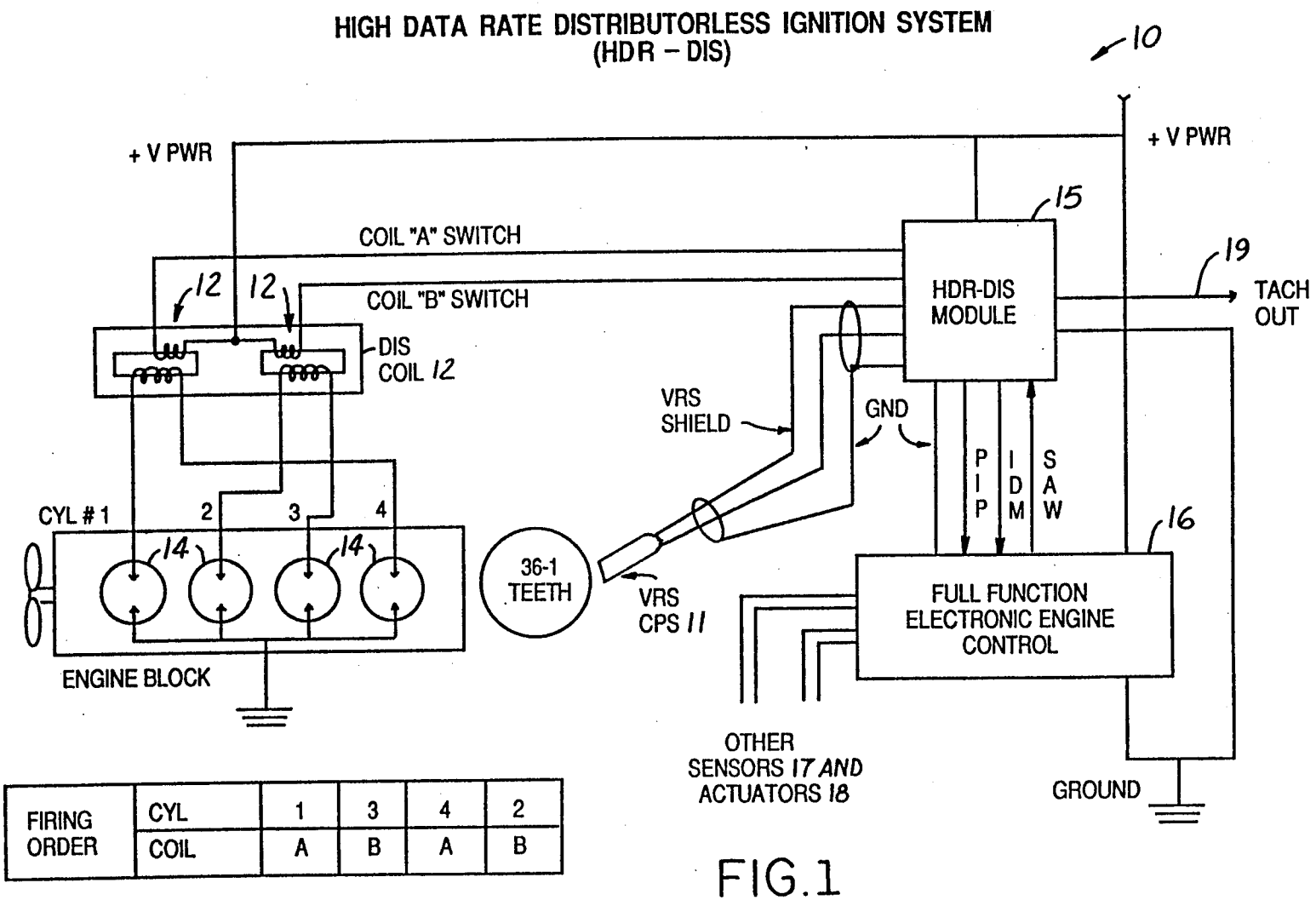
FIG. 1 is a schematic diagram, partly block, of an ignition system in accordance with an embodiment of this invention.

A high data rate distributorless ignition system (DIS) 10 as depicted in FIG. 1 includes a variable reluctance crankshaft position sensor (VRS, CPS) 11, a DIS 4-tower ignition coil 12, secondary spark plug wires 13, spark plugs 14, and a DIS high data rate (HDR) control module 15.

DIS 10 distributes and controls the spark energy to each spark plug 14 directly from an individual ignition coil 12 and an associated power driver. There is an ignition coil for every two spark plugs. Engine cylinders are paired (1,4 and 2,3) so that one cylinder is fired on the compression stroke and the other during the exhaust stroke.

An electronic engine control module 16 is coupled to ignition module 15, engine operating parameter sensors 17 and engine actuators 18. Engine control module 16 calculates a desired spark angle which is communicated to ignition module 15 using a pulse width modulated spark advance word (SAW) signal. Ignition module 15 controls coil current duration, determines coil firing time, selects the coil to fire, drives coil 12, drives a tachometer 19, generates an ignition diagnostic monitor signal (IDM), and processes the crankshaft position signal as a profile ignition pulse (PIP).

Based on the PIP and other engine sensor inputs, engine control module 16 calculates a desired spark advance angle and rather than sending out a spark timing output (SPOUT) signal in real time to control coil ON and OFF, engine control module 16 sends a spark angle target serially to ignition module 15 in a time window prior to the next cylinder event. The serial spark angle target signal is an asynchronous digital pulse with a width that is inversely proportional to increasing spark angle. Signal filtering and error detection occur in ignition module 15.

In summary, the high data rate distributorless ignition system 10 will execute spark control of the automotive ignition system. The primary functions of ignition module 15 include: processing of VRS 11 input for correct engine position, decoding SAW pulse width into recognizable spark advance, determining coil turn-on for zero excess dwell, synthesizing PIP to the engine controller, selecting the proper coil to charge, driving tachometer 19, provide diagnostic information to engine controller 16, providing ignition default in the event of engine controller 16 failure.

The various input/output (I/O) pins of ignition module 15 include:

VRS+ and VRS− - (I) Differential input voltage from a crankshaft position sensor 11. This input is generated by a crank mounted 35 tooth timing wheel which has a tooth every 10 degrees, with one tooth missing. Detection of the missing tooth allows synchronization and cylinder pair identification.

PIP - (O) Synthesized PIP signal of 50% duty cycle with rising edge at 10 degrees BTDC of each cylinder. This signal gives the engine control module 16 a precise reference of engine position and speed.

SAW - (I) This variable pulse width signal is used to pass a calculated Spark Advance Word from engine control module 16 to ignition module 15 for proper decoding into the intended spark target.

IDM - (O) This signal drives the tachometer and passes diagnostic information to engine control module 16 through a series of variable pulse width codes.

COIL DRIVE A,B,(C,D) - (O) Darlington driver circuits for each coil used for a cylinder pair.

VRS SHIELD - Electrical shield to protect differential VRS signal.

VPWR+ - (I) Power supply into ignition module 15 (regulated internally to +5 volts for microcomputer and logic circuits).

PWR GND and IGN GND - grounding pins for proper operation.

In normal operation of DIS 10, a spark advance target is calculated by the engine controller 16, and sent as a pulse width, between 64 and 1972 microseconds, on the SAW communication line to DIS module 15. The time duration value is recognized by module 15, and read into memory at 10 degrees ATDC of the present cylinder event. The value is decoded to extract the target spark advance and used to set the time at which the spark is to occur for the next cylinder firing. Pulse widths of SAW greater or less than pre-established limits are treated as errors and the previous valid target is executed until overridden by a new value or a default target is invoked. The SAW timer circuit is so constructed to return the same value of significant bits in the spark advance word for SAW pulses lengthened by 2048 microseconds.

In operation, repetitive spark can be accomplished by DIS 10 as follows. Spark advance for the upcoming cylinder event (SAW) is read in at 10 degrees ATDC of the previous cylinder event. When ignition module 15 reads a pulse width of 2048 us (typically at crank), this signals ignition module 15 that engine control module 15 will supply repetitive sparks. It can also act as a calibration pulse which eliminates variations in clock frequencies between engine control module 15 and ignition module 16. Advantageously, when a SAW is received with 2048 us added on to the normal pulse width and engine speed is less than 1200 RPM's, repetitive spark mode is entered for that cylinder event.

The repetitive spark mode is invoked in ignition module 15 by engine control module 16, by sending a pulse width of length 2048 ±64 micro seconds over the spark advance word (SAW) line. This repetitive spark code is used as an offset to extract the desired SAW. After a repetitive spark code has been received and validated, engine control module 16 can stop or restart repetitive spark mode by removing or adding the 2048 micro second offset to the desired SAW. This allows engine control module 16 to monitor engine temperature as a surrogate of the electronic module temperature, and in the event of module overheating, suspend the repetitive spark mode.

A repetitive spark SAW received without a prior valid repetitive spark code will be judged in error, Producing a out of range SAW code. Ignition module 15 will place the spark at the 10 degree before top dead center (BTDC) default. A repetitive spark SAW received above 1200 RPM will be treated as an out of range SAW. Advantageously, repetitive spark mode is used at an engine RPM range below 1000 RPM so there is sufficient time to send a SAW plus repetitive spark offset.

If the repetitive spark code is outside the acceptable range, ignition module 15 will not recognize repetitive spark mode. As previously stated, ignition module 15 will default to a 10 degree BTDC spark and send out-of-range SAW codes to engine control module 16. When multiple out-of-range SAW codes are detected, engine control module 16 can suspend repetitive spark mode.

An ignition coil turn-on time is calculated by ignition module 15 from the requested spark advance. Once coil 12 turns on, the next step is to calculate a turn-off time. After scheduling a coil turn-off, if a repetitive spark mode is desired, a flag is set which generates an interrupt on the falling edge of dwell. If normal spark mode is desired, the dwell command is applied to the next coil in sequence. If repetitive spark mode has been indicated by the time of the interrupt from the falling edge of dwell, the primary current is cycled on and off for a plurality of spark events with the same coil. The number of spark events can be predetermined by the control logic of ignition module 16. This routine is accomplished through a series of low level interrupts.

When the falling edge of the first dwell period comes in, a real time offset (spark duration) is added to an output compare register which currently contains the dwell-off time. When this time matches the real time, the primary current turns back on (interrupt generated). A new dwell period which is a certain percentage of the first dwell period is calculated. The percentage can be determined by the control logic of ignition module 16. This value is added to the current output compare value. When real time matches this value the primary current shuts off again to complete the second spark event. This process is continued until four spark events have occurred or the interrupt which indicates repetitive sparking is disabled.

The main interrupt for ignition module 16 occurs at ten degree intervals. At these times, various subroutines are entered based on current engine position, current dwell status, and repetitive spark mode indication. If repetitive spark mode is not desired there is normal operation of coil turn-on, coil turn-off, coil select, and processing of SAW. Typically, only one of these routines is executed on each ten degree interrupt. If repetitive spark mode is desired, the software decides on which subroutine to enter based on spark count (SPKCNT) indicating the number of sparks desired for that cylinder, as well as spark angle. If SPKCNT=0 normal operation continues. If SPKCNT is >1 and <4 and engine position is not TDC then the interrupt routine for repetitive spark runs. If engine position is TDC and SPKCNT >1 and <4 no subsequent sparks are generated, the interrupt is disabled, and the next coil is selected. If SPKCNT=4, the interrupt is disabled and the next coil is selected independent of the present crank angle.

Once the next coil is selected, the process starts over again. When the next requested spark advance comes in (10 degrees ATDC), ignition module 15 determines whether repetitive spark mode is desired using the aforementioned criteria of 2048 us added onto normal pulse width and engine speed <1200 RPM. Typically, up to four sparks are used. To prevent excessive heating of the coils and driver transistors, repetitive firing is allowed only below 1000 RPM, although higher speeds are possible at short duration (0.2 ms) sparks with repetition rates approaching 1.0 kHz.

Figure 2:
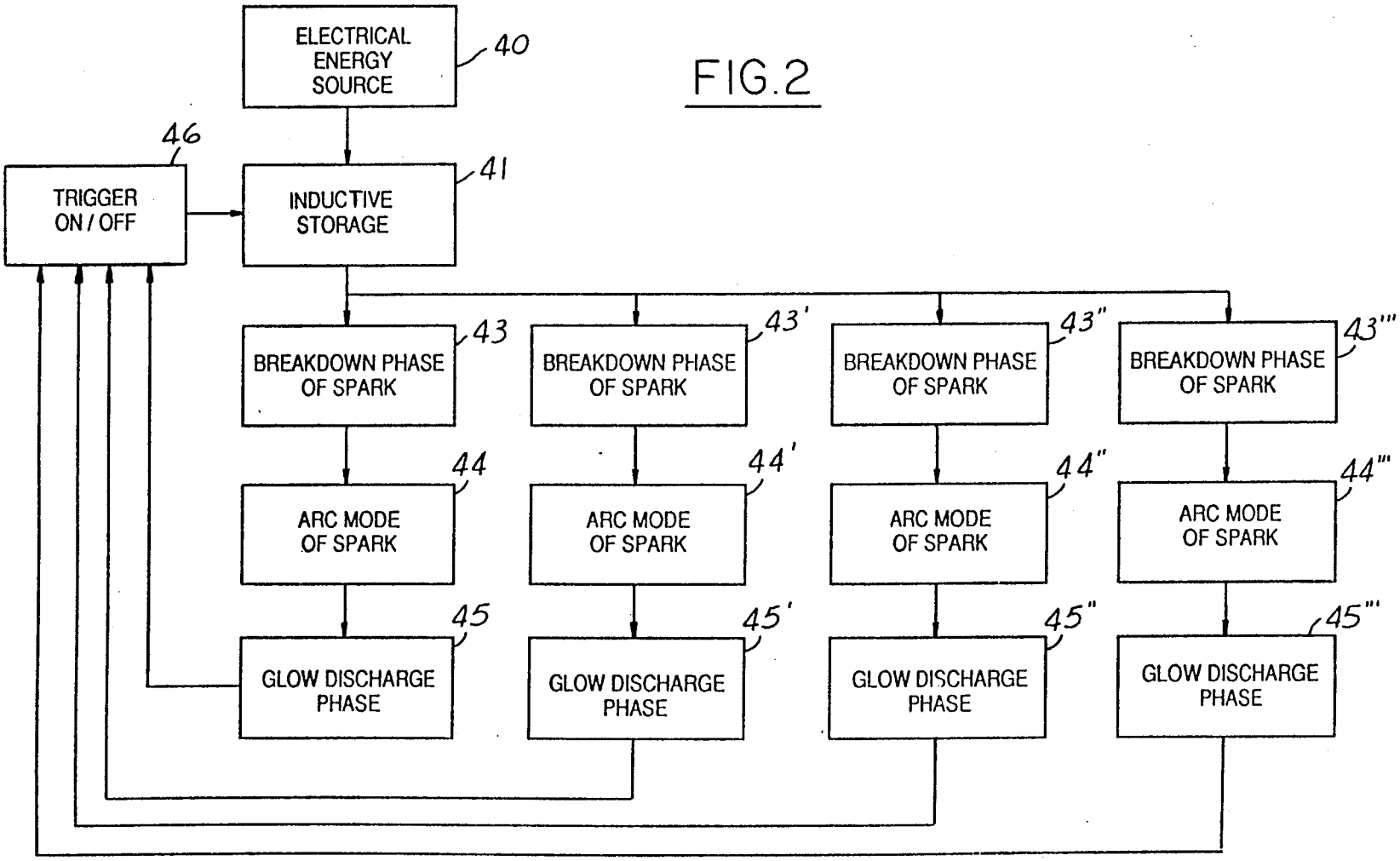
FIG. 2 is a logic flow diagram of a repetitive spark method in accordance with an embodiment of this invention.

Referring to FIG. 2, a logic flow diagram of an ignition system includes applying electrical energy from a source 40 to an inductive storage element 41. That is, electrical energy is drawn from a primary source 40 such as a storage battery, an alternator, or magneto, and stored in a magnetic field by the use of a current in an inductor until the instant a spark is required. A trigger signal from ON/OFF trigger block 46 terminates the current in inductive storage 41 causing a high voltage to be developed in the secondary winding of the ignition coil and delivered to a spark plug. The voltage rises to the breakdown potential as indicated at block 43 and discharges extremely fast causing the breakdown mode of current, typically greater than 100 amps, to flow for about one nanosecond.

Under unusually easy conditions, this breakdown ignition event at block 43 could initiate combustion but normally discharge progresses through the transition into an arc mode as indicated at block 44. This is characterized by a secondary current flowing for a short time, typically less than 1 microsecond at 10 to 90 amps. This releases additional thermal energy and may constitute an ignition event leading to combustion. However, normally transition to a glow discharge state at block 45 occurs. At this state there is a discharge of the remaining energy stored in the collapsing magnetic field. Typically, combustion begins during glow discharge mode block 45. Under turbulent mixture conditions, the glow discharge may be extinguished naturally and restrike if sufficient energy remains. In the forced repetitive spark mode, however, before all of the energy from inductive storage 41 is dissipated, the glow discharge state at block 45 is exited to return back to ON/OFF trigger 46. Thus, inductive storage 41 is retriggered to turn-on. This truncates the spark in progress, recovers the residual, unexpended magnetically stored energy, replenishes the spent energy by the use of source 40 applying energy to inductive storage 41 and begins a series of subsequent sparks to increase the number of ignition events and hence the probability of combustion by extending the time and total energy available for combustion.

These additional ignition events are shown by a second ignition event going from inductive storage 41 to a block 43' for a second breakdown phase; through 44', a second arc phase; and to 45', a second glow discharge which is exited early; thence upon retriggering, to a third ignition event (43'', 44'', 45'') similar to the others until exiting block 45'' at the completion of a full duration glow discharge mode. A fourth ignition event is also shown using blocks 43''', 44''', and 45'''. At low forced repetition frequencies, lean gas/fuel ratios and moderate gas flow through the electrode spacing, fully formed sparks (except for truncated glow durations) are produced. Combustion may be initiated at any point or at many points in the flow diagram, and the objective would be met to give a high probability of ignition under these more adverse conditions. Under more favorable combustion conditions, or after a flame has been fully established, the blocks depicting subsequent breakdown and arc phases may be bypassed and the glow phase entered directly after retriggering the source.

Figure 3:
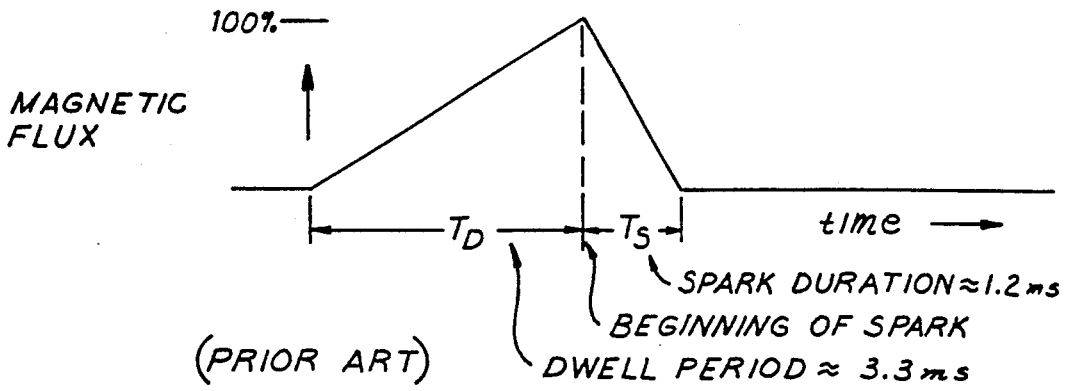
(PRIOR ART) FIG. 3
FIG. 3 is a graphical representation of magnetic flux versus time for a single spark ignition in accordance with the prior art.

Referring to FIG. 3, in normal single spark mode, energy is stored in the magnetic circuit as flux increases nearly linearly during the initial dwell period, $T_D$. At the desired spark instant, the primary current is cutoff nearly instantly, but the magnetic flux diminishes rather slowly as energy is transferred to the secondary electrical circuit and dissipated in the spark which lasts for approximately 1.2 milliseconds, $T_S$.

Figure 4:
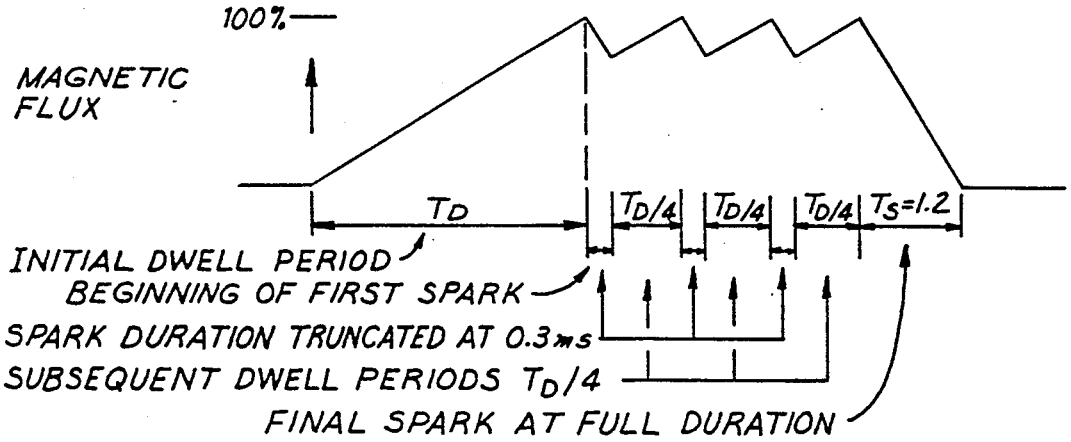
FIG. 4 is a graphical representation of magnetic flux versus time for a repetitive spark ignition in accordance with an embodiment of the invention.

Referring to FIG. 4, in repetitive spark mode, the primary electrical circuit to the battery is reenergized before the magnetic flux has had time to discharge completely. If only 0.3 milliseconds elapse after the spark has begun, the magnetic flux has fallen only 0.3/1.2 or 25% from the peak. It follows that a subsequent dwell period 25% of the original dwell is all that is required to replenish the energy (i.e. magnetic flux) lost to the previous 0.3 ms spark.

Figure 5:
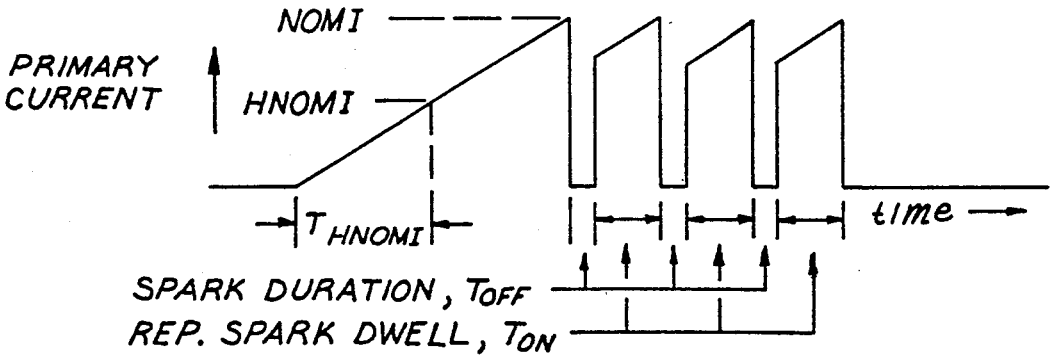
FIG. 5 is a graphical representation of primary current versus time for a repetitive spark ignition in accordance with an embodiment of this invention.

In actual practice, however, a little more energy is lost in the switching transient at the beginning of the spark, so subsequent dwell periods are intentionally lengthened appropriately. Instead of only $T_D/4$, the subsequent dwell periods are made $3T_D/8$ for spark durations truncated at 0.3 ms. The dwell for each of the repeated sparks is determined empirically and the following table illustrates practical values for various spark durations:

| For $T_{OFF}$ (Spark Duration) | Use $T_{ON}$ (Dwell Period) |
|---|---|
| 200 μs | $T_D'/4$ |
| 300 μs | $3T_D'/8$ |
| 500 μs | $T_D'/2$ |
| 750 μs | $5T_D'/8$ |
| 1.0 μs | $3T_D'/4$ |

where $T_D'$ is the dwell time to full nominal energy computed for the initial spark in the series. The primary current waveform is shown in FIG. 5.

Various modifications and variations will no doubt occur to those skilled in the art to which this invention pertains. For example, the number of sparks and duration of each spark may be varied from that disclosed herein. These and all other such variations which basically rely of the teachings through which this disclosure has advanced the art are properly considered within the scope of this invention.

I claim:

1. A distributorless ignition system for an internal combustion engine including:

a spark plug having spark electrodes located in a combustion space;

ignition spark generating apparatus coupled to the spark plug;

an ignition coil coupled to the spark plug;

an ignition control module coupled to the ignition coil;

an electronic engine control module coupled to the ignition module for determining desired spark advance; and said ignition control module being adapted to stop current through the ignition coil before a complete collapse of the magnetic field surrounding the ignition coil has taken place, to repetitively fire the spark plug during one combustion event in a cylinder of the engine, to set the individual spark durations, before the last spark in a spark series, to a fixed time selected as a function of the ratio of a present duration of the first spark to the normal discharge time of the ignition coil, and to set dwell period, subsequent to an initial dwell period, to be a function of an initial measured dwell period.

2. A distributorless ignition system as recited in claim 1 wherein said ignition control module determines the dwell time between successive sparks to be sufficiently long to replace the electrical energy already expended in the previous spark.

3. A distributorless ignition system as recited in claim 2 wherein said ignition control module controls the spark to have a duration sufficient to expend substantially all energy stored in said ignition coil.

4. A distributorless ignition system for an internal combustion engine including:

a spark plug having spark electrodes located in a combustion space:

ignition spark generating apparatus coupled to the spark plug;

an ignition coil coupled to the spark plug;

an ignition control module coupled to the ignition coil and including strategy control means for repetitively firing the spark plug;

an electronic engine control module coupled to the ignition module for determining desired spark advance; and said ignition control module being adapted to stop current through the ignition coil before a complete collapse of the magnetic field surrounding the ignition coil has taken place, to determine the dwell time between successive sparks to be sufficiently long to replace the electrical energy already expended in the previous spark, to control the spark to having a duration sufficient to expend substantially all energy stored in said ignition coil, to set the individual spark durations, before the last spark in a spark series, to a fixed time selected as a function of the ratio of a preset duration of the first spark to the normal discharge time, and to set dwell periods, subsequent to an initial dwell period, to be a function of the initial measured dwell period.

5. A method of generating repetitive spark firing for a distributorless ignition system, having a control means, an ignition coil and associated spark plugs, including the steps of:

determining the number of desired sparks to be applied during the firing of one cylinder;

determining the dwell time between successive sparks;

operating the ignition coil to produce the desired number of sparks and dwell time; and selecting a repetitive spark mode when engine speed is less than 1200 RPM and the pulse width of the engine spark angle command signal is changed.

6. A method of generating repetitive spark firing for a distributorless ignition system, having a control means, an ignition coil and associated spark plugs, including the steps of:

determining the number of desired sparks to be applied during the firing of one cylinder;

determining the dwell time between successive sparks;

operating the ignition coil to produce the desired number of sparks and dwell time;

monitoring engine temperature; and suspending repetitive spark firing if engine temperature exceeds a predetermined value.

7. A method of generating a repetitive spark as recited in claim 6 including the steps of:

waiting for the occurrence of the first of two sequential repetitive sparks; and setting the dwell period to be a function of the ratio of the duration of the first spark to the time it takes to discharge the magnetic flux of the ignition coil.

8. A method of generating a repetitive spark as recited in claim 7 wherein the step of setting the dwell period includes setting the dwell period to be longer than the time for the dwell period before an initial spark of a spark series multiplied by the ratio of the duration of the first spark to the ignition coil magnetic flux discharge time.

9. A method of generating repetitive spark firing for a distributorless ignition system, having a control means, an ignition coil and associated spark plugs, including the steps of:

selecting a repetitive spark mode when engine speed is less than 1200 RPM and the pulse width of the engine spark angle command signal is changed;

determining the number of desired sparks to be applied during the firing of one cylinder, determining the dwell time between successive sparks by waiting for the occurrence of the first of two sequential repetitive sparks and setting the dwell period to be a function of the ratio of the duration of the first spark to the time it takes to discharge the magnetic flux of the ignition coil so that the dwell period is longer than the time for the dwell period before an initial spark of a spark series multiplied by the ratio of the duration of the first spark to the ignition coil magnetic flux discharge time;

operating the ignition coil to produce the desired number of sparks and dwell time;

monitoring engine temperature; and suspending repetitive spark firing if engine temperature exceeds a predetermined value.

* * * * *